US010692664B2

(12) United States Patent
Zerr et al.

(10) Patent No.: US 10,692,664 B2
(45) Date of Patent: Jun. 23, 2020

(54) PRESELECTOR SWITCH ASSEMBLY FOR A VARIABLE TRANSFORMER

(71) Applicant: Maschinenfabrik Reinhausen GmbH, Regensburg (DE)

(72) Inventors: Eduard Zerr, Regensburg (DE); Andreas Stocker, Neutraubling (DE); Moritz Bengler, Regensburg (DE); Markus Zintl, Mitterteich (DE); Martin Pankofer, Plattling (DE); Wladimir Bauer, Regensburg (DE); Benedikt Ittlinger, Regensburg (DE); Gerhard Baeuml, Regenstauf (DE); Sebastian Rehkopf, Regensburg (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 687 days.

(21) Appl. No.: 15/502,985

(22) PCT Filed: Aug. 21, 2015

(86) PCT No.: PCT/EP2015/069240
§ 371 (c)(1),
(2) Date: Feb. 10, 2017

(87) PCT Pub. No.: WO2016/034438
PCT Pub. Date: Mar. 10, 2016

(65) Prior Publication Data

US 2017/0236658 A1 Aug. 17, 2017

(30) Foreign Application Priority Data

Sep. 4, 2014 (DE) ..... 10 2014 112 763

(51) Int. Cl.
*H01H 9/00* (2006.01)
*H01H 3/04* (2006.01)
*H01F 29/04* (2006.01)

(52) U.S. Cl.
CPC ..... *H01H 9/0038* (2013.01); *H01F 29/04* (2013.01); *H01H 3/04* (2013.01); *H01H 9/0044* (2013.01)

(58) Field of Classification Search
CPC .. H01H 9/0038; H01H 9/0044; H01H 9/0016; H01H 1/242; H01H 3/42;
(Continued)

(56) References Cited

U.S. PATENT DOCUMENTS 5,191,179 A * 3/1993 Yatchum ..... H01H 9/0027 200/11 TC
5,516,992 A * 5/1996 Dohnal ..... H01H 9/0044 200/11 TC
(Continued)

FOREIGN PATENT DOCUMENTS

DE 10200902535 A 12/2010
DE 102009025358 A1 12/2010
(Continued)

OTHER PUBLICATIONS

Translation of DE102009025358 (original document published Dec. 23, 2010) (Year: 2010).*
(Continued)

*Primary Examiner* — William A Bolton
(74) *Attorney, Agent, or Firm* — Andrew Wilford

(57) ABSTRACT

The invention relates to a switch assembly (1), in particular a preselector, for a variable transformer (4) having a first winding (2) and a second winding (3) with a first and a second tap (3.3, 3.4), said switch assembly comprising: a first connection terminal (2.1) that can be connected to the
(Continued)

first winding (2); a second connection terminal (3.1) that can be connected to the first tap (3.3); a third connection terminal (3.2) that can be connected to the second tap (3.4); a first, second, third and fourth fixed contact (5.1, 5.2, 5.3, 5.4); a vacuum interrupter (6); a first moving contact (7) that can be contacted selectively with the first or second fixed contact (5.1, 5.2); a second moving contact (8) that can be contacted selectively with the third or fourth fixed contact (5.3, 5.4), wherein the second and the fourth fixed contact (5.2, 5.4) are connected to the second connection terminal (3.1), the first and the third fixed contact (5.1, 5.3) are connected to the third connection terminal (32) the first moving contact (7) is connected to the first connection terminal (2.1) via the vacuum interrupter (6), and the second moving contact (8) is connected to the first connection terminal (2.1).

11 Claims, 9 Drawing Sheets

(58) Field of Classification Search
CPC ..... H01H 2033/667; H01H 33/143; H01H 9/0005; H01H 9/0011; H01H 2009/0022; H01F 29/04; H01F 29/025
USPC ..... 218/4; 200/11 TC; 336/150
See application file for complete search history.

(56) References Cited

U.S. PATENT DOCUMENTS

| | | | | |
|---|---|---|---|---|
| 5,594,223 | A * | 1/1997 | Fukushi | H01H 9/0038 200/11 TC |
| 6,849,813 | B1 | 2/2005 | Albrecht | |
| 8,576,038 | B2 * | 11/2013 | Kraemer | H01F 29/04 336/145 |
| 9,130,477 | B2 | 9/2015 | Marquardt | |
| 9,257,246 | B2 | 2/2016 | Hoepfl et al. | |
| 2014/0159847 | A1 | 6/2014 | Wrede | |
| 2014/0176273 | A1 * | 6/2014 | Elick | H01H 3/605 336/150 |

FOREIGN PATENT DOCUMENTS

| | | | |
|---|---|---|---|
| EP | 0294653 | A | 12/1988 |
| EP | 0294653 | A1 | 12/1988 |

OTHER PUBLICATIONS

Translation of EP0294653 (Original document published Dec. 1988) (Year: 1988).*

* cited by examiner

PRESELECTOR SWITCH ASSEMBLY FOR A VARIABLE TRANSFORMER

CROSS REFERENCE TO RELATED APPLICATIONS

This application is the US-national stage of PCT application PCT/EP2015/069240 filed 21 Aug. 2015 and claiming the priority of German patent application 102014112763.3 itself filed 4 Sep. 2014.

FIELD OF THE INVENTION

The present invention relates to a switch assembly, in particular a preselector, for a control transformer for selectable connection of a first winding and a second winding of the control transformer.

BACKGROUND OF THE INVENTION

Preselectors, which can be constructed as reversers, coarse selectors or multiple coarse selectors, generally serve the purpose in an on-load tap changer for a control transformer with main winding and regulating winding of widening the regulating range of the control transformer, also termed tapped transformer. Reversers make it possible to connect the regulating windings with the main winding selectably in the same sense or in opposite sense to the main winding. Coarse selectors make it possible to connect a larger part of the main winding, i.e. a so-called coarse step winding or coarse step, selectably with the regulating winding or not, thus to bridge over the coarse step winding.

Not only the step winding of a control transformer, but also the coarse step are briefly electrically separated from the main winding during switching-over thereof by reversers or coarse selectors. In that case they are subject to an electrical potential that results from the voltages of the adjacent windings as well as the coupling capacitances with respect to those windings and with respect to grounded components. The resulting difference voltages are in part considerable; they load the switching paths of the opening preselector contacts and if at a relevant level can lead to impermissible discharges. Discharges of that kind, also called arcs, cause formation of gas in the insulating oil of the on-load tap changer. This is undesirable, particularly since with increasing system voltages the proportion of undesired gases increases.

DE 10 2009 025 358 describes a tap changer with a preselector for uninterrupted switching over between different winding taps of a regulating winding of a tapped transformer. The preselector comprises two fixed preselector contacts and can be constructed as a reverser or coarse selector. One fixed preselector contact is electrically connected with the start of the regulating winding and the other fixed preselector contact is electrically connected with the end of the regulating winding. A movable contact is provided, whose root terminal is electrically connected with the main winding of the tapped transformer and that selectably connects one of the fixed preselector contacts. The movable contact is constructed to be longitudinally displaceable and has a switching chamber hermetically sealed off relative to the environment and in which similarly longitudinally displaceable contact members are disposed. The contact members, when switched onto one of the fixed preselector contacts, are closed against the force of a spring, but are opened during switching over between the fixed preselector contacts. A disadvantage of this known tap changer is that the arrangement, drive and mounting of the switching chamber have a substantial constructional cost and require a large amount of installation space.

OBJECT OF THE INVENTION

It is the object of the invention to provide a switch assembly for a control transformer that makes possible a simple construction with a small amount of constructional space.

SUMMARY OF THE INVENTION

In the following, a formulation of the kind "A is connected with B" has the meanings "A is directly electrically conductively connected with B" and "A is indirectly, thus via C, electrically conductively connected with B" and a formulation of the kind "A is attached to B" has the meaning "A is directly electrically conductively connected with B."

The invention proposes a switch assembly for a control transformer having a first winding and a second winding with a first and a second tap, comprising:

- a first connection terminal connectable with the first winding;
- a second connection terminal connectable with the first tap;
- a third connection terminal connectable with the second tap;
- a first, second, third and fourth fixed contact;
- a vacuum interrupter;
- a first movable contact selectably contractible with the first or second fixed contact; and
- a second movable contact selectably contractible with the third or fourth fixed contact;

wherein

- the second and fourth fixed contacts are connected with the second connection terminal;
- the first and third fixed contacts are connected with the third connection terminal;
- the first movable contact is connected with the first connection terminal by the vacuum interrupter; and
- the second movable contact is connected with the first connection terminal.

Through use of a vacuum interrupter in conjunction with movable contacts and fixed contacts the proposed switch assembly makes possible a particularly simple and compact construction. Through separation of the vacuum interrupter from the movable contacts and fixed contacts it is possible to arrange these independently of one another and thus make best possible utilization of the available installation space. The vacuum interrupter additionally prevents creation of gases in the insulating oil. The open vacuum interrupter increases voltage strength and prevents creation of arcs between the movable contacts and fixed contacts.

The proposed switch assembly can be constructed as required in any desired mode and manner and, for example, can comprise at least one or no additional vacuum interrupters.

The vacuum interrupter is preferably mounted to be stationary or fixed in location, particularly relative to the movable contacts, so that the construction of the switch assembly can be designed to be particularly compact. For actuation of the vacuum interrupter, this does not have to be moved therewith.

For preference, in the case of, for example, a three-phase configuration of the control transformer it is provided that three of the proposed switch assemblies are arranged one above the other, in which case the movable contacts and the vacuum interrupters of all switch assemblies are actuated by a common switching tube.

The first movable contact, the first fixed contact and second fixed contact are preferably disposed in a dielectric medium or air or SF6 or insulating oil and/or are formed by a mechanical changeover switch that, in particular, does not comprise any vacuum interrupters or semiconductor switches.

The second movable contact, third fixed contact and fourth fixed contact are preferably disposed in a dielectric medium or air or SF6 or insulating oil and/or are formed by a mechanical changeover switch that, in particular, does not comprise any vacuum interrupters or semiconductor switches.

It can be provided that the vacuum interrupter is mounted in stationary position between an upper mount and a lower mount on at least one contact rod.

It can be provided that a rocker lever for opening and closing the vacuum interrupter is mounted in the upper mount.

It can be provided that the movable contacts are mounted on a switching tube in parallel one above the other;

the switching tube is mounted to be rotatable; and the movable contacts execute a pivot movement through rotation of the switching tube.

It can be provided that a cam disk is mounted on the switching tube;

the cam disk executes a pivot movement through rotation of the switching tube; and the cam disk mechanically co-operates with the rocker lever in the upper mount and opens or closes the vacuum interrupter.

It can be provided that each movable contact comprises a housing with contact fingers that at a first end are mechanically slidably and electrically conductively connected with a diverter ring associated with the respective movable contact and at a second end can be selectably connected with the respective fixed contact.

It can be provided that the first tap and the second tap are each arranged at a respective end of the second winding.

It can be provided that the switch assembly comprises a fourth connection terminal connectable with a third tap of the second winding between the first tap and the second tap; and a resistance connected with the fourth connection terminal.

The fourth connection terminal can be connected, for example, by the resistance with ground, earth potential or a diverter of the control transformer. The diverter in turn can be connected, for example, with ground or earth potential.

It can be provided that the switch assembly comprises an isolator connected with the fourth connection terminal in series with the resistance and/or a vacuum interrupter connected with the fourth connection terminal in series with the resistance.

It can be provided that the switch assembly is constructed as a preselector and particularly as a reverser or coarse selector.

BRIEF DESCRIPTION OF THE DRAWING

Forms of embodiment of the invention are explained in more detail in the following by example with reference to the accompanying drawings. However, the individual features evident therefrom are not restricted to the individual forms of embodiment, but can be connected and/or combined with further above-described individual features and/or with individual features of other forms of embodiment. The details in the drawings are to be understood as explanatory, but not limiting. The reference numerals contained in the claims are not to restrict the scope of protection of the invention in any way, but merely refer to the forms of embodiment shown in the drawings. In the drawings:

SPECIFIC DESCRIPTION OF THE INVENTION

Figure 1:
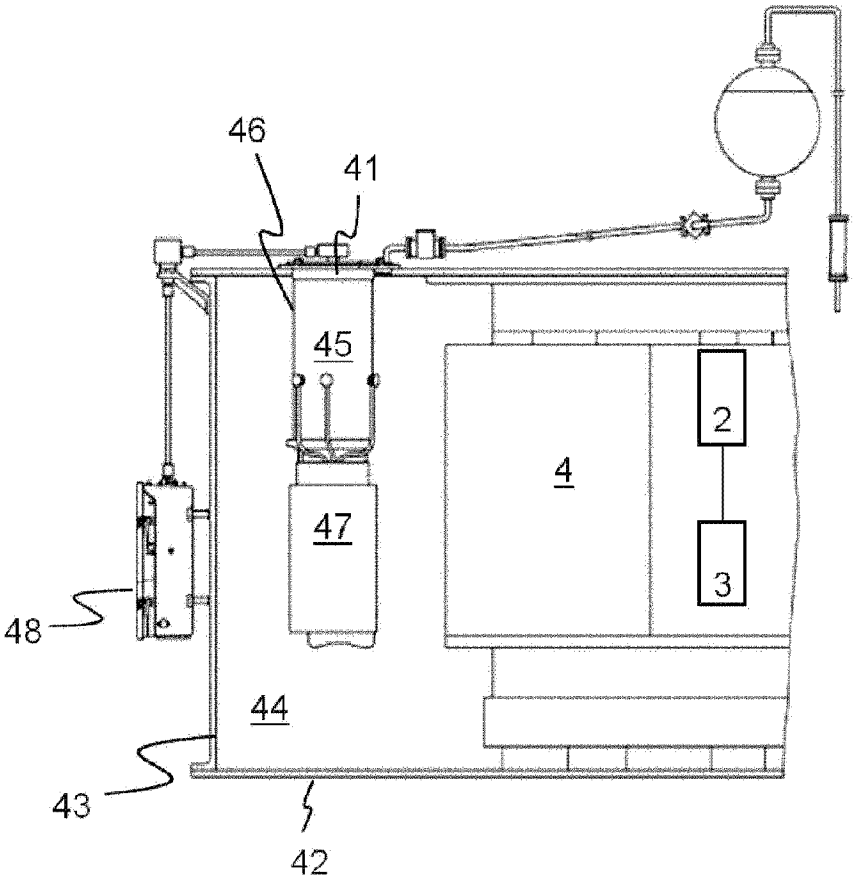
FIG. 1 shows a control transformer with an on-load tap changer that comprises a load changeover switch and a selector as well as a switch assembly according to the invention.

In FIG. 1 there is schematically shown an embodiment of a control transformer 4 that has an upper voltage side or primary side with a first winding 2 and a second winding 3, a lower voltage side or secondary side 40 and an on-load tap changer 46 with a load changeover switch 45, a selector 47 and a switch assembly 1 according to the invention. The control transformer 4 is enclosed by a transformer housing 42. The different winding taps 13 (see FIG. 2) of the control transformer 4 can be connected with the on-load tap changer 46 arranged in the interior 44 of the transformer housing 42. In order to be able to ensure correct functioning of the control transformer 4 the on-load tap changer 46 has to execute the required switching sequence without disturbances. The on-load tap changer 46 projects into the transformer housing 42 that depending on the type of control transformer 4 can be filled with oil. The on-load tap changer 46 here comprises, by example, a load changeover switch 45 and selector 47, but can also be constructed as a load selector.

The on-load tap changer 46 is actuated through a linkage by a motor drive 48 fastened to an outer wall 43 of the transformer housing 42. However, the motor drive 48 can also be directly mounted on the cover 41, thus on the head of the on-load tap changer 46.

The control transformer 4 usually has for each phase at least one first winding 2 and second winding 3, which can be electrically connected together by the switch assembly 1 that can be constructed as a reverser or coarse selector, as will be described in detail in the following with reference to FIG. 2.

Figure 2A:
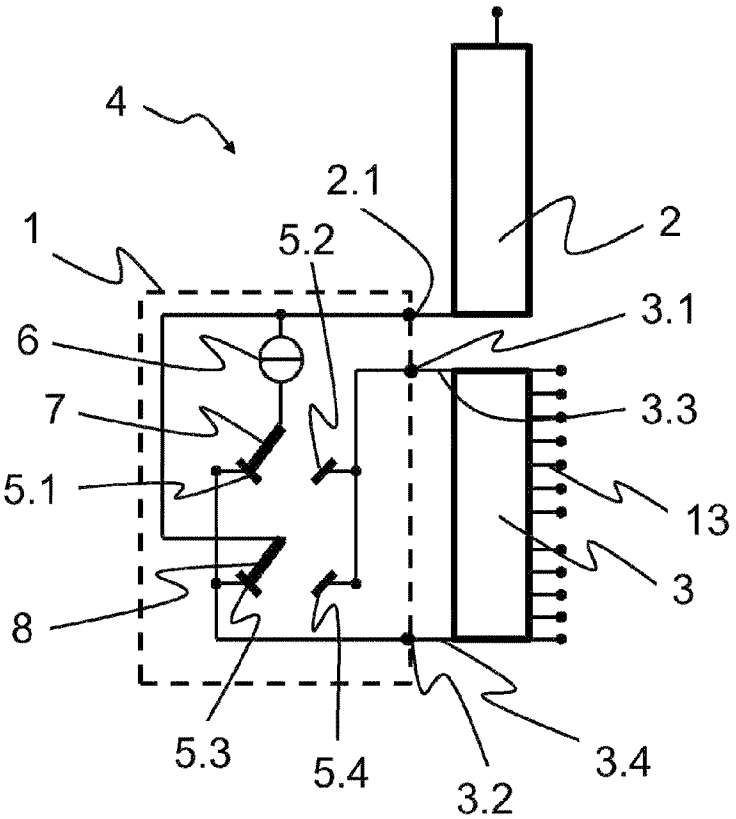
FIGS. 2*a-g* circuit diagrams of a first embodiment of the switch assembly as well as a switching sequence of the switch assembly.

A circuit diagram of a first embodiment of the switch assembly 1 for an on-load tap changer 46 is schematically illustrated in FIG. 2*a*. The switch assembly 1 comprises three connection terminals 2.1, 3.1, 3.2, wherein the first connection terminal 2.1 is connected with the first winding 2, the second connection terminal 3.1 is connected with a first tap 3.3 of the second winding 3 and the third connection terminal 3.2 is connected with a second tap 3.4 of the second winding 3. The first and second taps 3.3, 3.4 are respectively attached to the ends of the second winding 3.

In this embodiment the first winding 2 is constructed as main winding and the second winding 3 as regulating winding and the switch assembly 1 fulfils the function of a reverser.

Moreover, the switch assembly 1 comprises four fixed contacts 5.1, 5.2, 5.3 and 5.4, a stationary vacuum interrupter 6 and two movable contacts 7, 8. The second and fourth fixed contacts 5.2, 5.4 are electrically conductively connected with the second connection terminal 3.1. The first and third fixed contacts 5.1, 5.3 are electrically conductively connected with the third connection terminal 3.2.

The first movable contact 7 is electrically conductively connected with the first connection terminal 2.1 by the vacuum interrupter 6. The second movable contact 8 is electrically conductively connected directly with the first connection terminal 2.1. The first movable contact 7 can be connected or contacted selectably with the first fixed contact 5.1 or second fixed contact 5.2. The second movable contact 8 can be connected or contacted selectably with the third fixed contact 5.3 or fourth fixed contact 5.4.

In the setting of the switch assembly 1 illustrated in FIG. 2*a* the first winding 2 is electrically conductively connected with the third connection terminal 3.2 on the one hand by the vacuum interrupter 6, the first movable contact 7 and the first fixed contact 5.1 and on the other hand and parallel thereto by the second movable contact 8 and the third fixed contact 5.3.

Figure 2C:
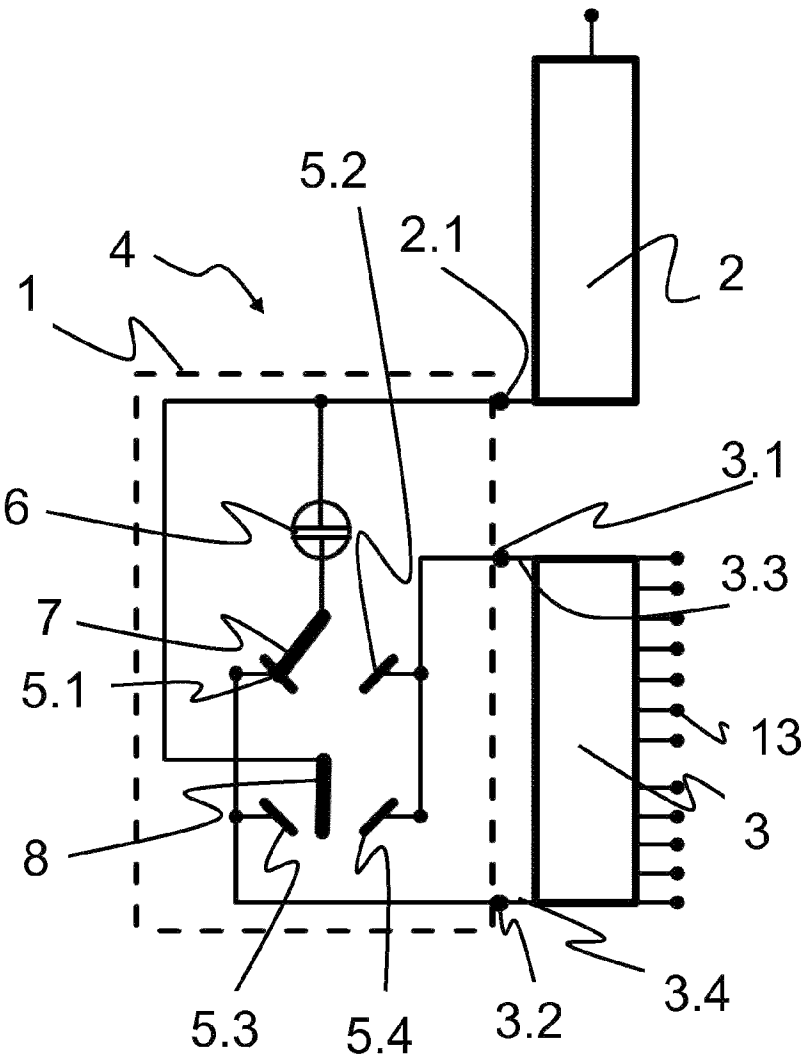
Figure 2B:
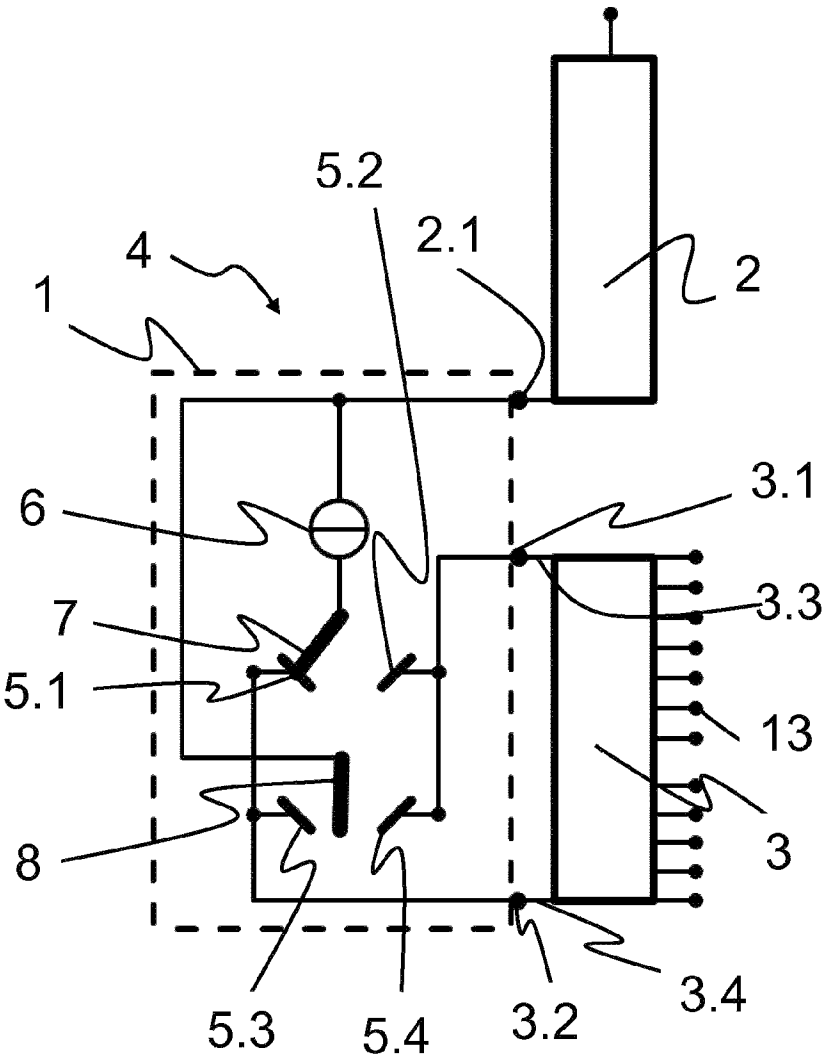

FIG. 2*b* shows the first step of a switching-over process of the switch assembly 1 of FIG. 2*a*. In that case, initially the second movable contact 8 is detached from the third fixed contact 5.3, so that the first winding 2 is connected with the third connection terminal 3.2 of the second winding 3 only still by the vacuum interrupter 6, the first movable contact 7 and the first fixed contact 5.1.

FIG. 2*c* shows the second step, in which the vacuum interrupter 6 is opened so that there is no electrically conductive connection between the first and second windings 2, 3.

Figure 2E:
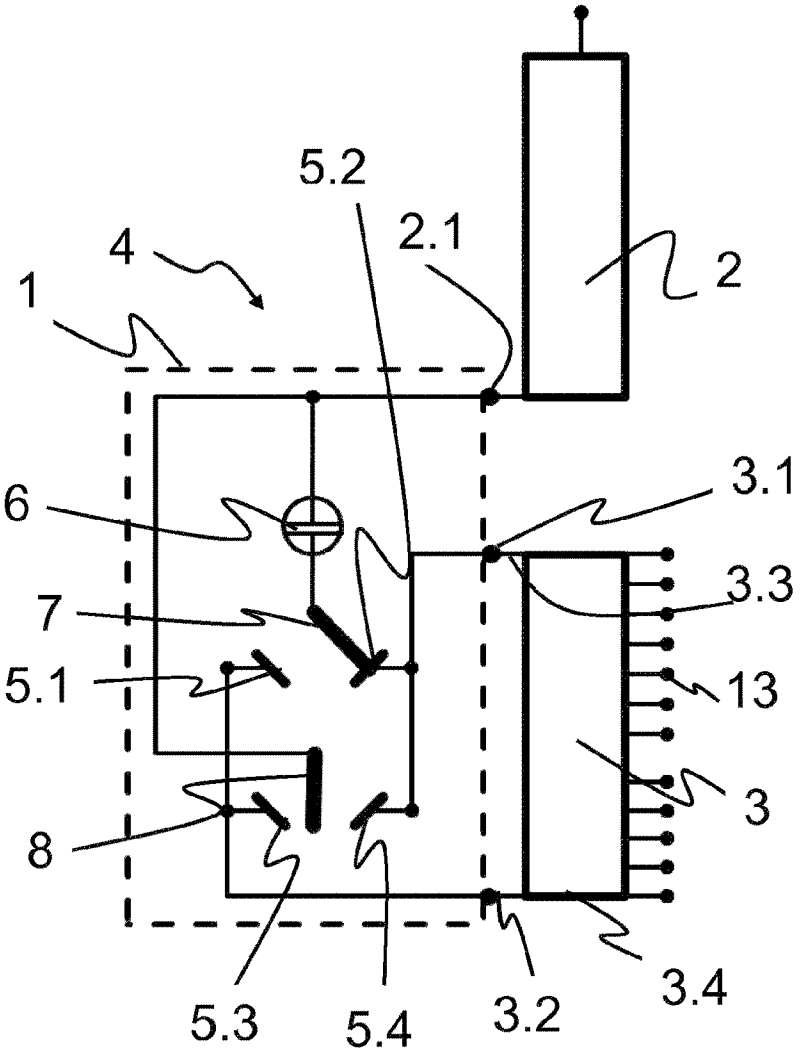
Figure 2D:
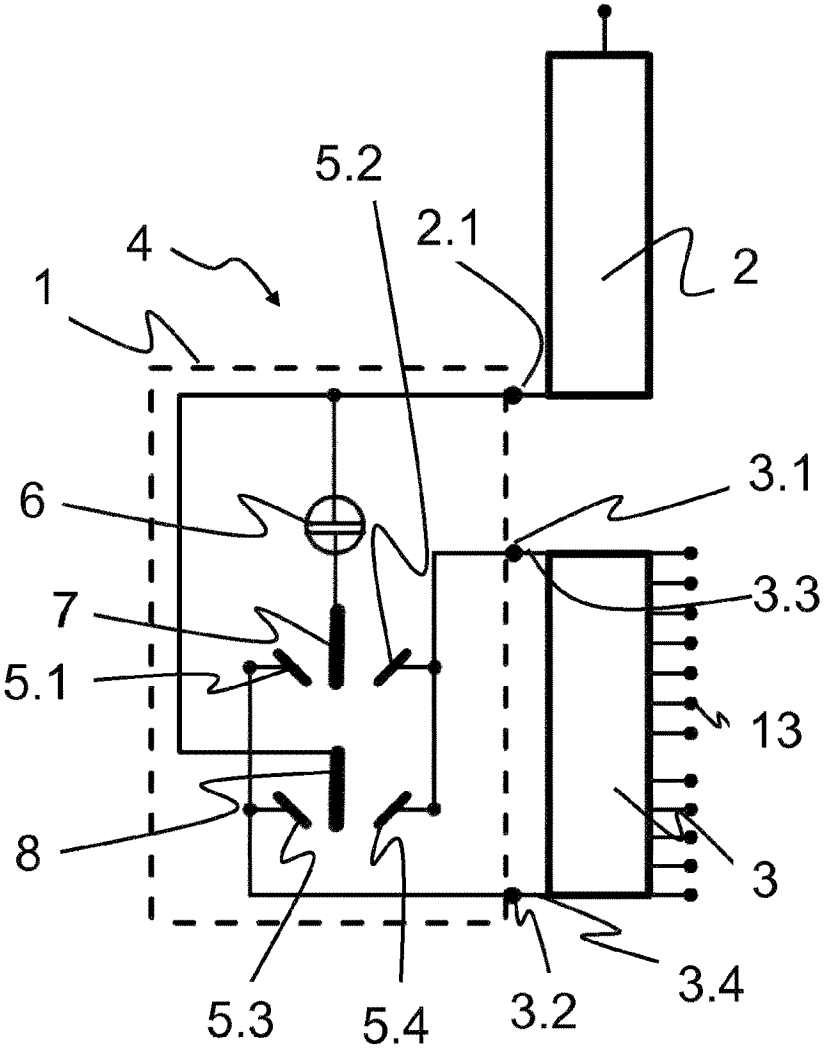

FIG. 2*d* shows the third step, in which the first movable contact 7 is detached from the first fixed contact 5.1.

FIG. 2*e* shows the fourth step in which the first movable contact 7 is switched to the second fixed contact 5.3.

Figure 2G:
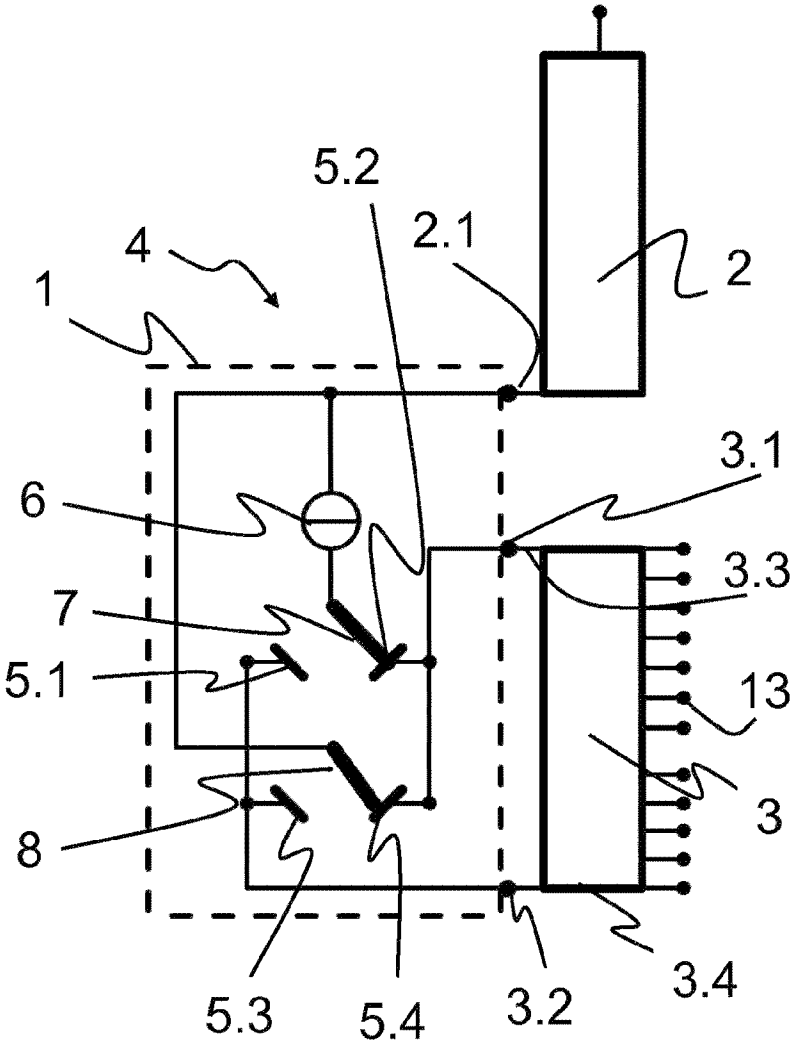
Figure 2F:
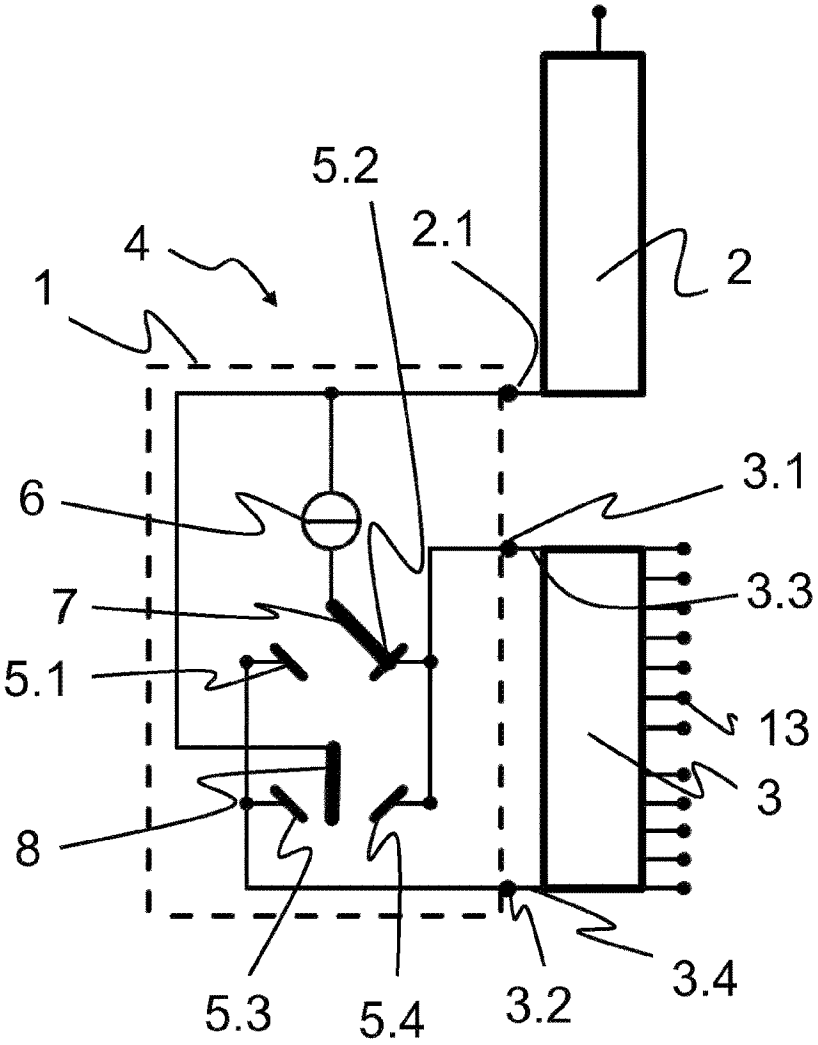

FIG. 2*f* shows the fifth step in which the vacuum interrupter 6 is closed so that the first winding 2 is electrically conductively connected with the second connection terminal 3.1 by the vacuum interrupter 6, the first movable contact 7 and the second fixed contact 5.2.

FIG. 2*g* shows the sixth step in which the second movable contact 8 is switched to the fourth fixed contact 5.4, so that the first winding 2 is electrically conductively connected with the second connection terminal 3.1 on the one hand by the vacuum interrupter 6, the first movable contact 7 and the second fixed contact 5.2 and on the other hand and parallel thereto by the second movable contact 8 and the fourth fixed contact 5.4.

Switching-over in opposite direction takes place analogously in reverse sequence.

Figure 3:
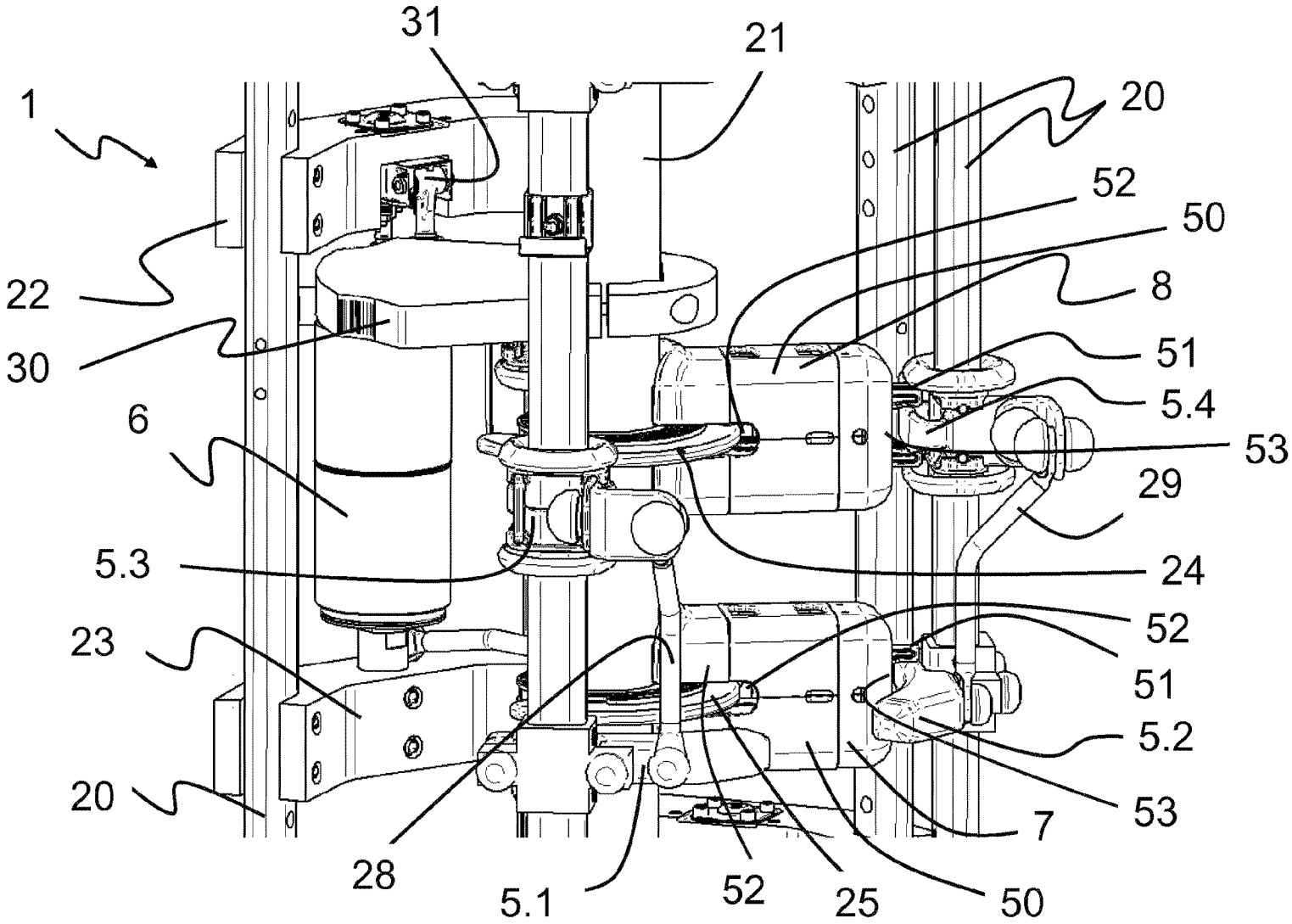
FIG. 3 is a perspective view of a preferred embodiment of the switch assembly of FIGS. 2*a-g* as a constructional configuration for one phase.
Figure 4:
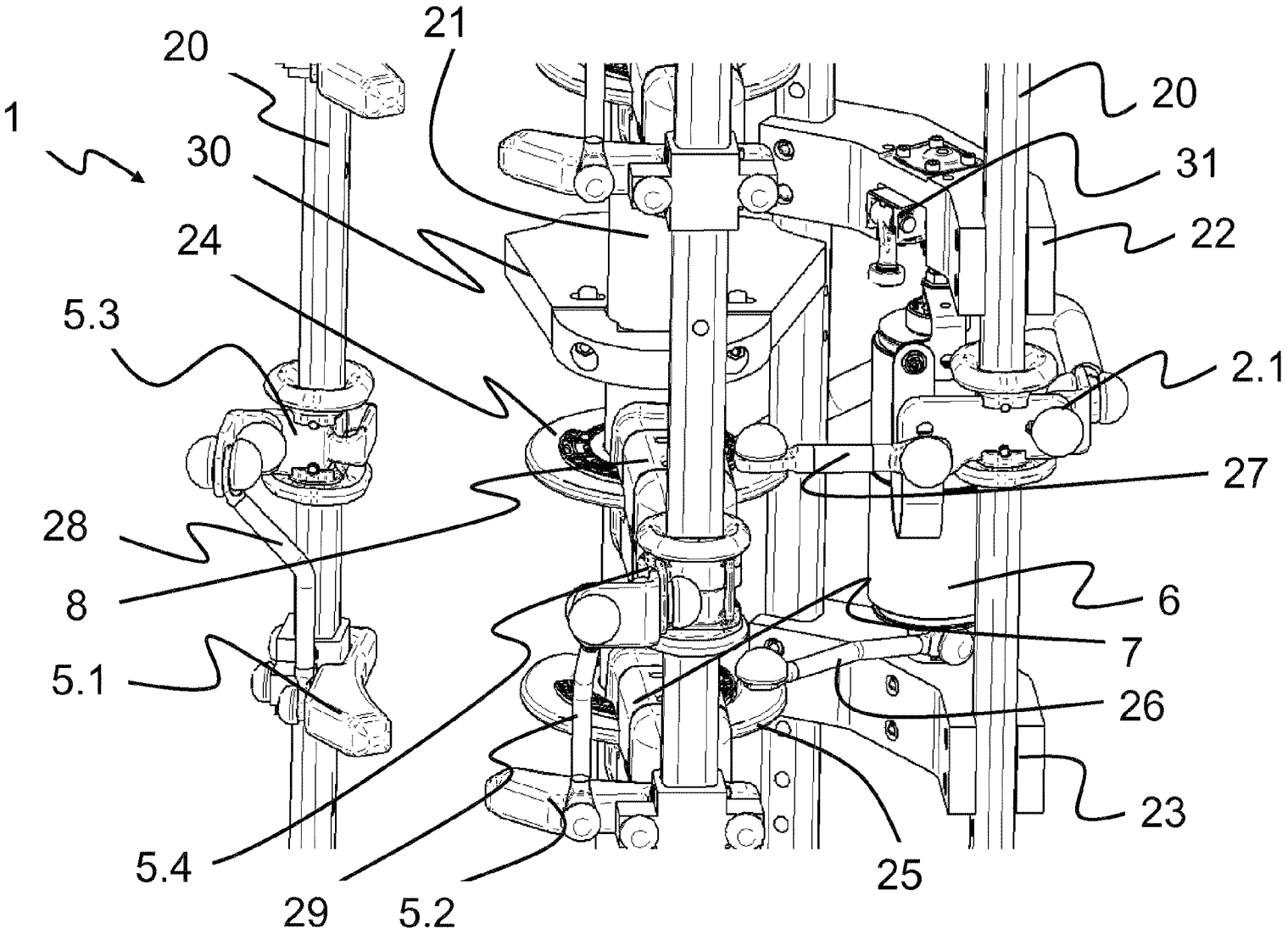
FIG. 4 is another perspective view of the switch assembly of FIG. 3.

A preferred embodiment of the switch assembly 1 of FIGS. 2*a-g* is schematically illustrated in FIGS. 3 and 4 as a constructional format for one phase.

In this embodiment the switch assembly 1 comprises a plurality of vertical contact rods 20 that are disposed in a circle and arranged around a vertical switching tube 21. In that case, the vacuum interrupter 6 is mounted in fixed location or to be stationary and parallel to the contact rods 20, thus vertically, between an upper mount 22 and a lower mount 23. The two mounts 22, 23 are fastened to at least one contact rod 20.

A first diverter ring 24 and a second diverter ring 25 are mounted on the switching tube 21. The two diverter rings 24 and 25 are mounted so that a relative movement between these and the switching tube 21 is possible. In that case, the diverter rings 24 and 25 are fixedly installed and the switching tube 21 can be rotated about its own axis between two positions.

The second diverter ring 25 is electrically conductively connected with the vacuum interrupter 6 by a line 26. The line 26 fixes the second diverter ring 25. The first movable contact 7 is secured to the switching tube 21 and through rotation of the switching tube 21 produces an electrically conductive connection between the second diverter ring 25 and selectably the first fixed contact 5.1 or the second fixed contact 5.2.

The first diverter ring 24 is electrically conductively connected directly with the first connection terminal 2.1 by a line 27. The line 27 fixes the first diverter ring 24. The second movable contact 8 is also fastened to the switching tube 21 and through rotation of the switching tube 21 produces an electrically conductive connection between the first diverter ring 24 and selectably the third fixed contact 5.3 or the fourth fixed contact 5.4.

During rotation of the switching tube 21 the two diverter rings 24 and 25 remain in a fixed position and do not rotate in company with the switching tube 21.

The first and second movable contacts 7 and 7 are mounted preferably parallel to one another horizontally on the switching tube 21. When switching is carried out, the movable contacts 7 and 8 execute a pivot movement and thus connect the four fixed contacts 5.1-5.4. In that case, the second and fourth fixed contacts 5.2, 5.4 are mounted one above the other on a contact rod 20 and electrically conductively connected by a line 29. The first and third fixed contacts 5.1, 5.3 are fastened to an adjacent contact rod 20 and similarly electrically conductively connected by a line 28. The third and fourth fixed contacts 5.3, 5.4 are each constructed in such a way that on rotation of the switching tube 21 the second movable contact 8 firstly detaches from the respective fixed contact 5.3, 5.4, whilst the first movable contact 7 moves in parallel therewith, but remains switched for a longer period of time onto the first or second fixed contact 5.1, 5.2.

Each movable contact 7, 8 comprises a housing 50 and contact fingers 51 that are resiliently mounted therein and that extend from a first end 52 to a second end 53 through the interior of the housing 50. A sliding connection always guaranteed during rotation of the switching tube 21, is present between the first end 52 of the contact fingers 51 and the respective diverter ring 24, 25. The second end 53 of the contact fingers 51 similarly slides on the respective fixed contacts 5.1-5.4 onto or off these.

In addition, a cam disk 30 is mounted on the switching tube 21 and similarly executes a pivot movement when rotation of the switching tube 21 takes place. When the pivot movement takes place, the cam disk 30 co-operates with a rocker lever arrangement 31, by which the vacuum interrupter 6 is opened or closed.

The switch assembly 1 is constructed in such a way that through the arrangement of the movable contacts 7, 8, the fixed contacts 5.1-5.4 and the cam disk 30 on the switching tube 21 a switching-over process according to FIGS. 2*a*-2*g* can be carried out.

Figure 5B:
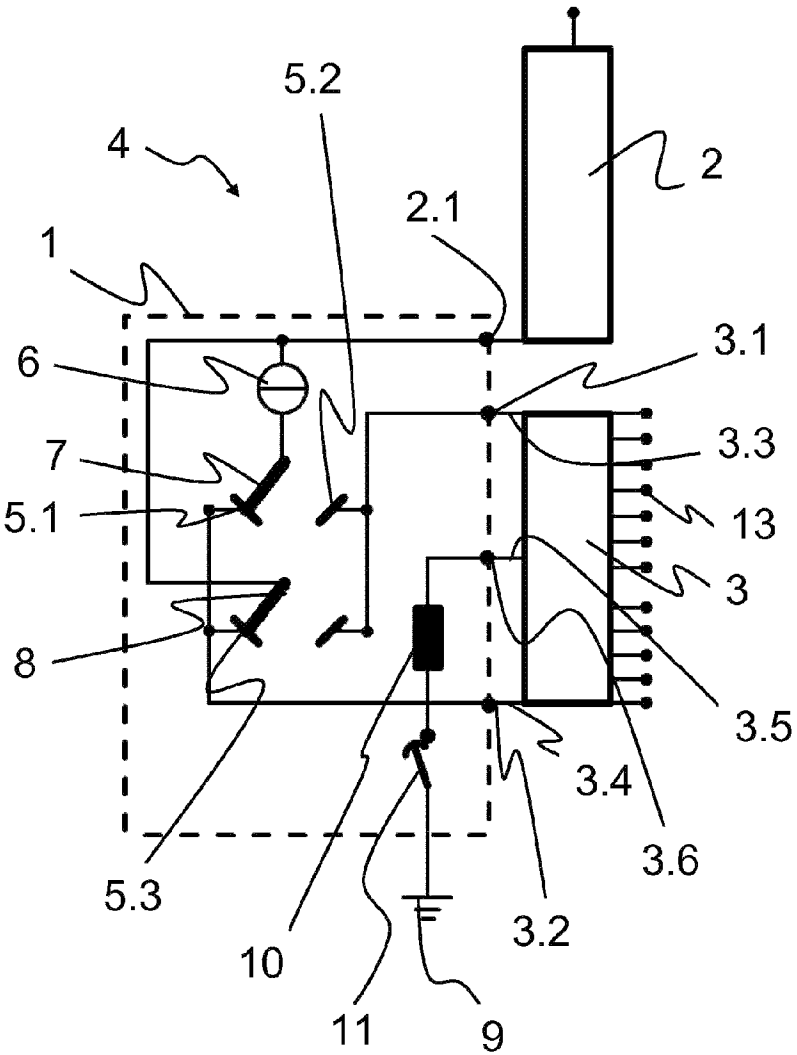
FIGS. 5*a-d* are circuit diagrams of second, third, fourth and fifth embodiments of the switch assembly.
Figure 5A:
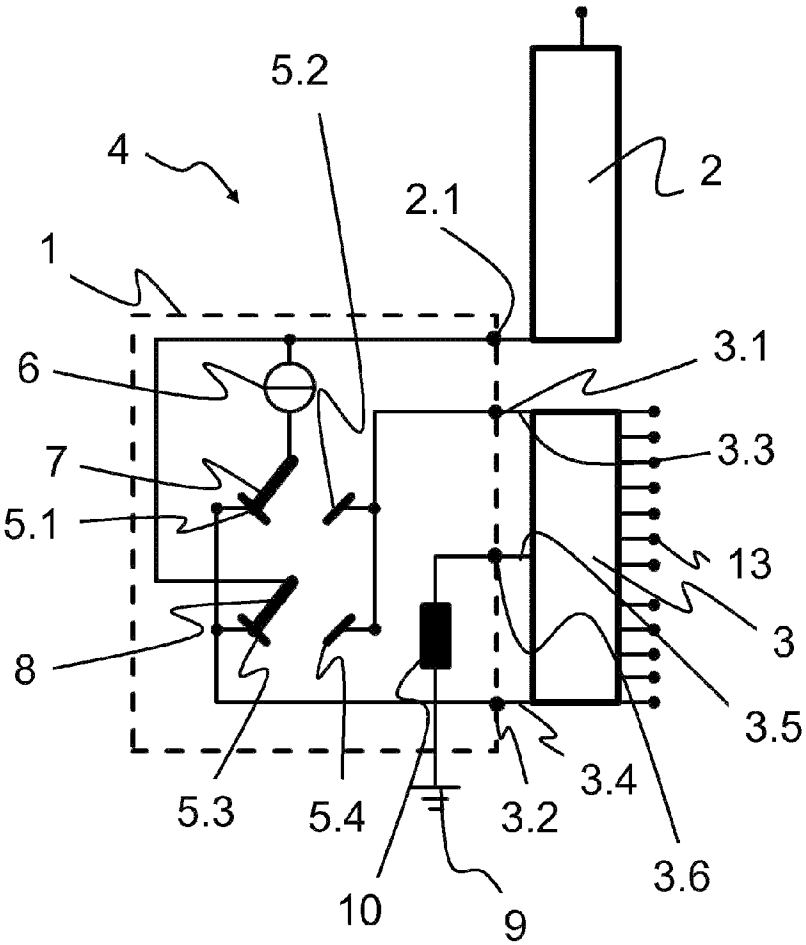

A second embodiment of the switch assembly 1 is schematically illustrated in FIG. 5*a*. This embodiment is similar to the first embodiment, so that primarily the differences are explained in more detail in the following.

In this embodiment the switch assembly 1 comprises a fourth connection terminal 3.6 connectable with a third tap 3.5 of the second winding 3 between the first tap 3.3 and the second tap 3.4, preferably in the center. A resistor 10 electrically conductively connected with ground potential 9 is attached to the fourth connection terminal 3.6. This resistor serves as polarity resistance during a switching-over process of the switch assembly 1.

A third embodiment of the switch assembly 1 is schematically illustrated in FIG. 5*b*. This embodiment is similar to the second embodiment, so that primarily the differences are explained in more detail in the following.

In this embodiment, connected between ground potential 9 and the resistor 10 is an isolator 11 with the help of which the resistor 10 can be electrically isolated from ground potential 9. The isolator 11 is closed prior to actuation of the two movable contacts 7, 8 and is opened after switching-over of the movable contacts 7, 8 has taken place.

Figure 5D:
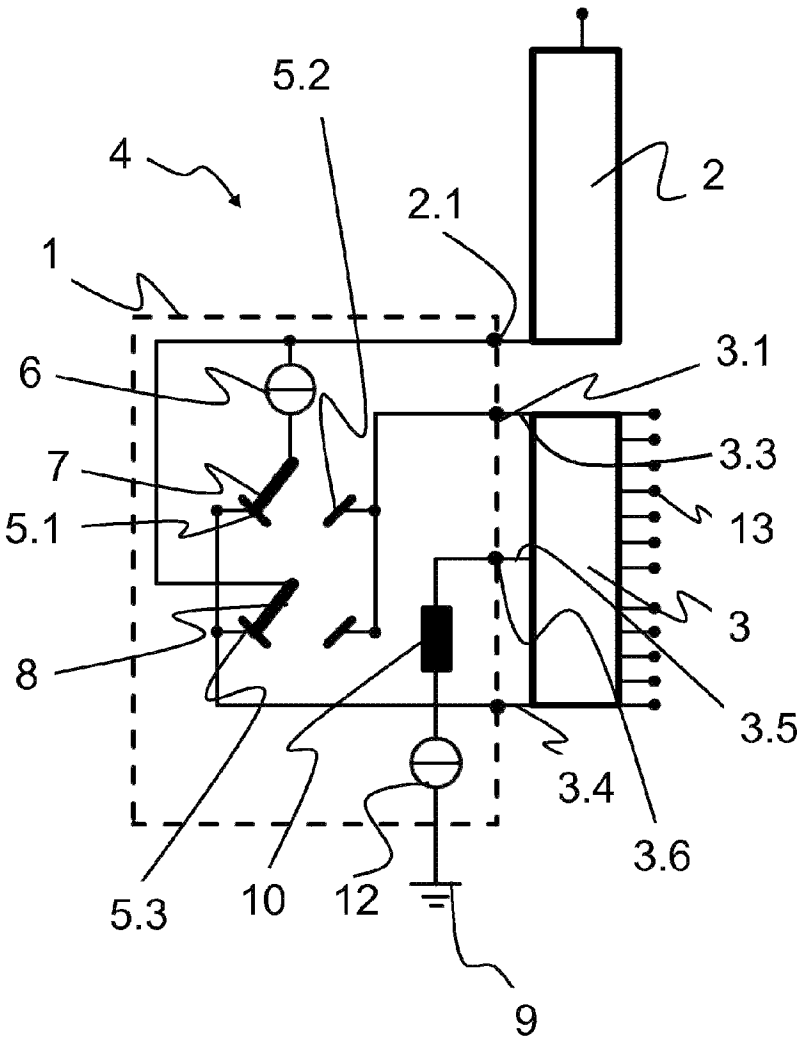
Figure 5C:
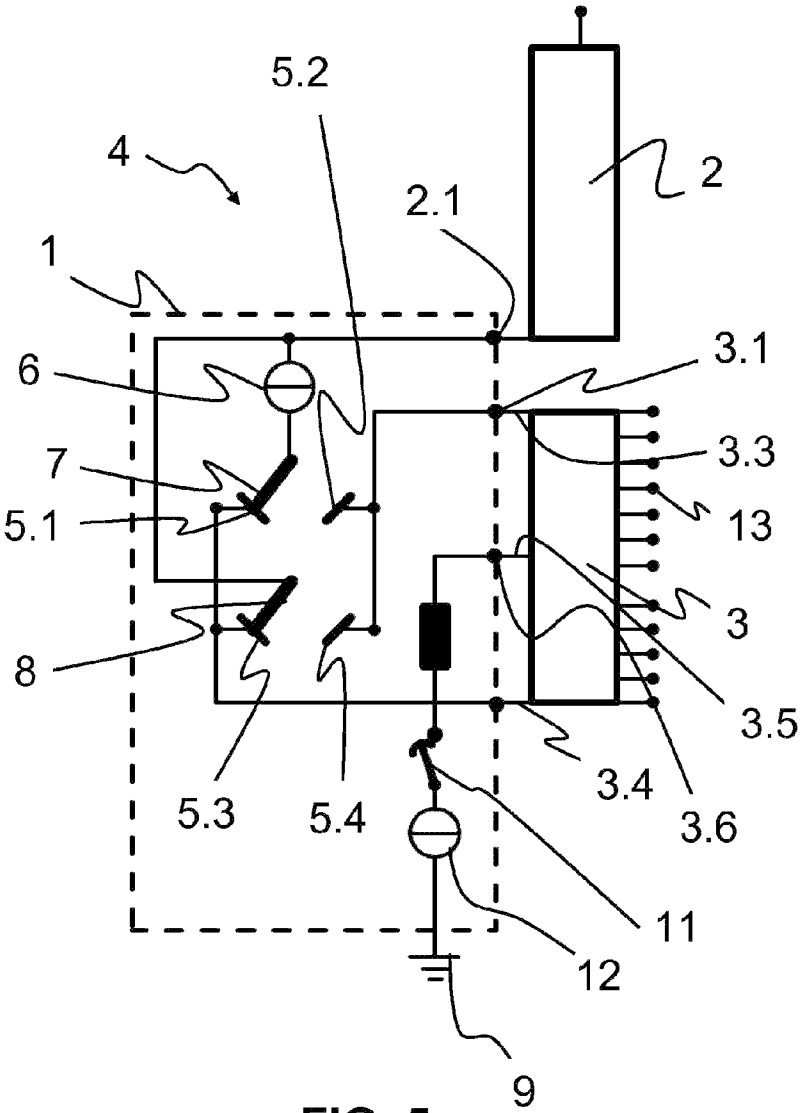

A fourth embodiment of the switch assembly 1 is schematically illustrated in FIG. 5*c*. This embodiment is similar to the third embodiment so that primarily the differences are explained in more detail in the following.

In this embodiment, connected between ground potential 9 and the isolator 11 is a vacuum interrupter 12 with the help of which the resistor 10 can be electrically separated from ground potential 9 before the isolator 11 is actuated. The arrangement or sequence of resistor 10, isolator 11 and vacuum interrupter 12 between the fourth connection terminal 3.6 and ground potential 9 can be designed as desired. The vacuum interrupter 12 is closed after closing of the isolator 11, thus before actuation of the movable contacts 7, 8. The vacuum interrupter 12 is opened before opening of the isolator 11, thus after actuation of the movable contacts 7, 8.

A fifth embodiment of the switch assembly 1 is schematically illustrated in FIG. 5*d*. This embodiment is similar to the fourth embodiment so that primarily the differences are explained in more detail in the following.

In this embodiment the isolator 11 is eliminated, so that only the vacuum interrupter 12 is arranged between ground potential 9 and the resistor 10.

Figure 6:
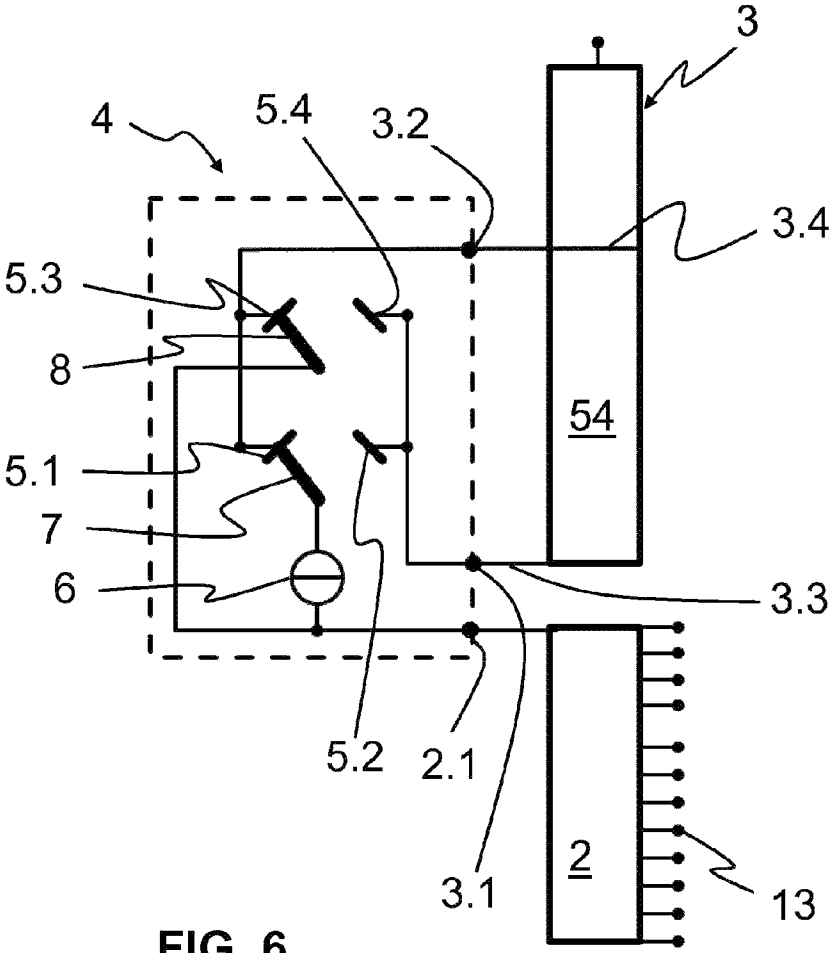
FIG. 6 is a circuit diagram of a sixth embodiment of the switch assembly.

A sixth embodiment of the switch assembly 1 is schematically illustrated in FIG. 6. This embodiment is similar to the first embodiment so that primarily the differences are explained in more detail in the following.

In this embodiment the first winding 2 is constructed as a regulating winding and the second winding 3 as a main winding and the second tap 3.4 is arranged, by example, at a position in the lower third of the second winding 3, wherein the part between the taps 3.3 and 3.4 is termed coarse step winding or coarse step 54. The switch assembly 1 fulfils the function of a coarse selector. However, the second tap 3.4 can also be arranged at any other desired place of the second winding 3.

Figure 7:
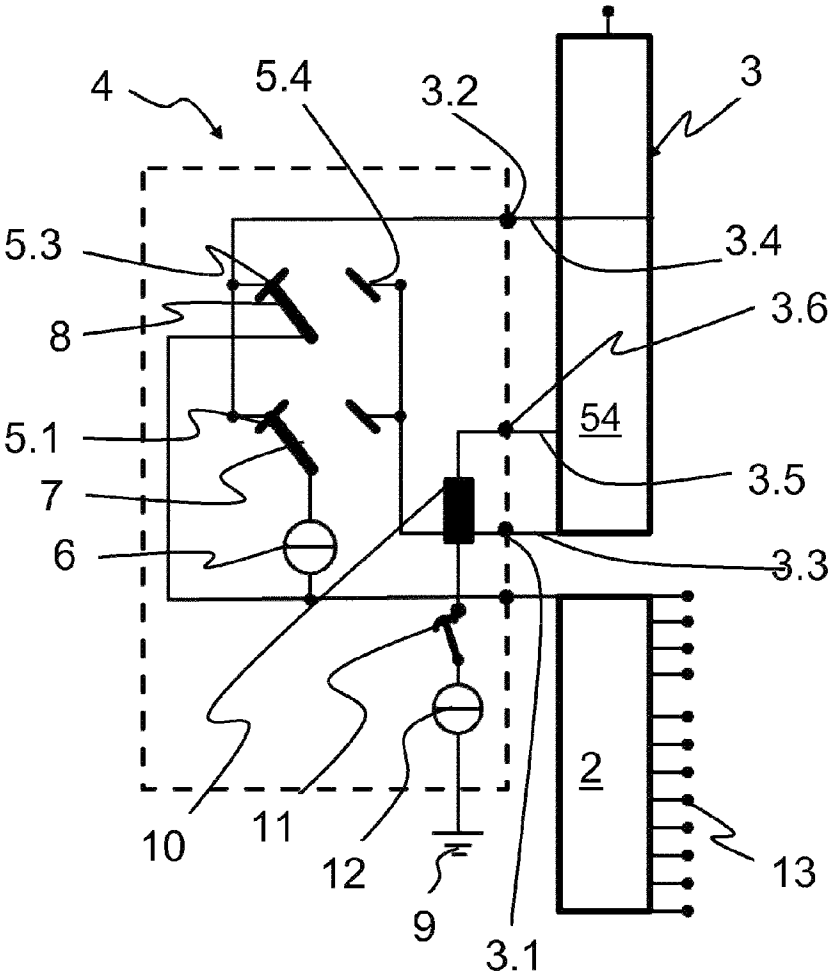
FIG. 7 is a circuit diagram of a seventh embodiment of the switch assembly.

A seventh embodiment of the switch assembly 1 is schematically illustrated in FIG. 7. This embodiment is similar to the sixth embodiment so that primarily the differences are explained in more detail in the following.

In this embodiment the switch assembly 1 comprises a fourth connection terminal 3.6 connectable with a third tap 3.5 of the second winding 3 between the first tap 3.3 and the second tap 3.4, preferably in the center. A series circuit electrically conductively connected with ground potential 9 and consisting of resistor 10, isolator 11 and vacuum interrupter 12 is attached to the fourth connection terminal 3.6 similarly to the fifth embodiment. The resistor 10 serves as polarity resistance for the switching-over process of the switch assembly 1. The isolator 11 and/or vacuum interrupter 12 can also be excluded depending on requirements.

The invention claimed is:

1. A preselector switch assembly for a control transformer having a first winding and a second winding with a first tap and a second tap, the assembly comprising:

a first connection terminal connectable with the first winding;

a second connection terminal connectable with the first tap;

a third connection terminal connectable with the second tap;

a first fixed contact connected with the third connection terminal;

a second fixed contact connected with the second connection terminal;

a third fixed contact connected with the third connection terminal;

a fourth fixed contact connected with the second connection terminal;

a vacuum interrupter;

a first movable contact selectably contactable with the first or second fixed contact, separate from and operable independently of the vacuum interrupter, and connected through the vacuum interrupter with the first connection terminal; and a second movable contact connected with the first connection terminal and selectably contactable with the third or fourth fixed contact.

2. The switch assembly according to claim 1, wherein the vacuum interrupter is fixed between an upper mount and a lower mount on at least one contact rod.

3. The switch assembly according to claim 2, further comprising:

a rocker lever for opening and closing the vacuum interrupter and mounted in the upper mount.

4. The switch assembly according to claim 3, wherein the movable contacts are mounted on a switching tube in parallel with each other;

the switching tube is rotatable; and the movable contacts pivot on rotation of the switching tube.

5. The switch assembly according to claim 4, further comprising:

a cam disk mounted on the switching tube, pivotal on rotation of the switching tube and mechanically cooperating with the rocker lever in the upper mount to open or close the vacuum interrupter independently of the first movable contact by opening the vacuum interrupter before moving the first movable contact off one of the first and second fixed contacts and closing the vacuum interrupter after the first movable contact contacts the other of the first and second fixed contacts.

6. The switch assembly according to claim 1, wherein each movable contact comprises a housing with contact fingers that at a first end are mechanically slidably and electrically conductively connected with a diverter ring associated with a respective one of the movable contacts and at a second end is selectably connectable with a respective one of the fixed contacts.

7. The switch assembly according to claim 1, wherein the first tap and the second tap are each arranged at a respective end of the second winding.

8. The switch assembly according to claim 1, further comprising:

a fourth connection terminal connectable with a third tap of the second winding between the first tap and the second tap; and a resistor connected with the fourth connection terminal.

9. The switch assembly according to claim 8, further comprising:

an isolator connected with the fourth connection terminal in series with the resistor or the vacuum interrupter connected with the fourth connection terminal in series with the resistor.

10. The switch assembly according to claim 1 and that is constructed as a preselector, reverser or coarse selector.

11. The switch assembly according to claim 1, further comprising:

means coupling the vacuum interrupter to the first fixed contact for opening the vacuum interrupter before moving the first movable contact off one of the first and second fixed contacts and closing the vacuum interrupter after the first movable contact contacts the other of the first and second fixed contacts.

* * * * *